US005411091A

United States Patent [19]

Jennings, Jr.

[11] Patent Number: 5,411,091

[45] Date of Patent: May 2, 1995

[54] USE OF THIN LIQUID SPACER VOLUMES TO ENHANCE HYDRAULIC FRACTURING

[75] Inventor: Alfred R. Jennings, Jr., Plano, Tex.

[73] Assignee: Mobil Oil Corporation, Fairfax, Va.

[21] Appl. No.: 164,270

[22] Filed: Dec. 9, 1993

[51] Int. Cl.[6] ..... E21B 43/267

[52] U.S. Cl. ..... 166/280; 166/308

[58] Field of Search ..... 166/271, 280, 308

[56] References Cited

U.S. PATENT DOCUMENTS

| | | | |
|---|---|---|---|
| 2,838,116 | 6/1958 | Clark, Jr. et al. | 166/280 |
| 3,335,797 | 8/1967 | Braunlich, Jr. | 166/280 |
| 3,349,851 | 10/1967 | Huitt et al. | 166/280 |
| 3,850,247 | 11/1974 | Tinsley | 166/280 |
| 4,067,389 | 1/1978 | Savins | 166/246 |
| 4,078,609 | 3/1978 | Pavlich | 166/280 X |
| 4,249,609 | 2/1981 | Haafkens et al. | 166/280 |
| 4,378,849 | 4/1983 | Wilks | 166/369 |
| 5,074,359 | 12/1991 | Schmidt | 166/280 |
| 5,271,466 | 12/1993 | Harms | 166/308 X |

*Primary Examiner*—George A. Suchfield
*Attorney, Agent, or Firm*—Alexander J. McKillop; George W. Hager, Jr.; Charles A. Malone

[57] ABSTRACT

A method for enhanced hydraulic fracturing which comprises injecting a proppant laden fracturing fluid into a formation or reservoir at a rate and pressure sufficient to fracture said formation. Next, a thin spacer fluid is injected into the created fracture. Afterwards, a proppant laden fracturing fluid is injected into the formation at a rate and pressure sufficient to hold the created fracture open which allows proppant to be more evenly distributed throughout the created fracture as proppant falls through the spacer fluid thereby avoiding proppant convection in the created fracture while obtaining substantially improved propping of the fracture.

12 Claims, 1 Drawing Sheet

USE OF THIN LIQUID SPACER VOLUMES TO ENHANCE HYDRAULIC FRACTURING

FIELD OF THE INVENTION

This invention is directed to a method for fracturing a subterranean earth formation penetrated by a least one well wherein a fluid spacer is used with a slug of proppant laden fracturing fluid.

BACKGROUND OF THE INVENTION

Techniques for hydraulically fracturing subterranean formations by injecting a fracturing fluid down a well and into the formation under sufficient pressure to create fractures in a formation are well known. Proppant materials are generally entrained in the fracturing fluid and are deposited in the fracture to keep the fracture open.

After fracturing the formation, hydrocarbonaceous fluids are produced from the formation into the well. These produced fluids may carry sand entrained therein, particularly when the subsurface formation is as unconsolidated formation. Produced sand is undesirable for many reasons. It is abrasive to components found within the well, such as tubing, pumps and valves, and must be removed from the produced fluids at the surface. Further, produced sand may partially or completely clog the well, subsequently inhibiting production thereby making necessary an expensive workover. In addition, sand flowing from the subsurface formation may leave therein a cavity which may result in caving of the formation and collapse of a well casing.

Often after completion of hydraulic fracturing, a steam-flood or other heat generating method is used to heat the formation to remove hdyrocarbonaceous fluids therefrom after having placed a proppant into the created fractures. Proppants utilized in this manner keep the created fractures from closing. They also assist in reducing undesired fines from being carried from the formation with the produced fluids. Also, proppants increase the permeability thereby allowing more intimate contact of the heating medium with the formation. Generally sand is used as a proppant.

Based on recent research concerning proppant slurry transport in hydraulic fractures, it has become more apparent that density effects of slurry volume are important in the deposition of proppant material used in a treatment to hold the fracture open. During the fracturing treatment, a neat fluid i.e., fracturing fluid without proppant therein, is used to create a hydraulic fracture.

Under fracturing pressure, following the creation of the initial fracture, a fracturing fluid containing a proppant therein, is injected into the created fracture. Because the proppant is added to the slurry in increasing concentrations, the effective density of the slurry is greater. Therefore, proppant has a tendency to fall to the bottom of the created fracture. The phenomena related to this type of proppant settling has been called "convection."It is described in SPE paper 24825 authored by M. P. Cleary and A. Fonseca. This paper was presented at the 67th Annual Technical Conference and Exhibition of the SPE. It is entitled "Proppant Convection and Encapsulation in Hydraulic Fracturing: Practical Implications of Computer and Laboratory Simulations".

Therefore, what is needed is a method for effective proppant placement during fracturing which will diminish the "convection effect" so as to allow more effective proppant deposition in the main part of the created fracture.

SUMMARY OF THE INVENTION

This invention is directed to a method for enhanced hydraulic fracturing. In the practice of this invention, a neat fracturing fluid is injected into the formation under a pressure and at a rate sufficient to create a fracture. Next, a proppant laden fracturing fluid is injected into the formation at a pressure and rate sufficient to hold open said fracture with said proppant. Thereafter, a thin spacer fluid is injected into the created fracture. Afterwards, a proppant laden fracturing fluid is injected into the formation or reservoir at a rate and pressure sufficient to hold the created fracture open which allows proppant to be more evenly distributed throughout the created fracture as proppant falls through the spacer fluid. In this manner, the effects of proppant convection in the created fracture are enhanced while substantially improved propping is obtained in the main part of the fracture.

It is therefore an object of this invention to enhance proppant convection in a created fracture during hydraulic fracturing.

It is another object of this invention to provide for a method for that will allow an even distribution of proppant over the main part of a fracture created during a hydraulic fracturing operation.

DESCRIPTION OF THE PREFERRED EMBODIMENTS

In the practice of this invention, a fracturing method is utilized to induce fractures into a hydrocarbonaceous fluid bearing formation to increase its permeability. Prior to fracturing the formation a well is cased and then selectively perforated over a one to two foot interval in a productive interval of a formation. A hydraulic fracturing technique which can be used herein is disclosed in U.S. Pat. No. 4,067,389 which issued to Savins on Jan. 10, 1978. Another method for initiating hydraulic fracturing is disclosed by Medlin et al. in U.S. Pat. No. 4,378,849 which issued on Apr. 5, 1983. Both patents are hereby incorporated by reference herein. As is known by those skilled in the art, in order to initiate hydraulic fracturing in a formation, the hydraulic pressure applied must exceed the formation pressures in order to cause a fracture to form. The fracture which forms would generally run perpendicular to the least principle stress in the formation or reservoir.

The fracturing fluid which is used herein to hydraulically fracture the formation comprises a viscous gel. Ungelled fluids can also be used. The viscous gel can include a water-based hydroxypropyl guar and (HPG) hydroxyethyl cellulose (HEC), carboxymethylhydroxyethyl cellulose (CMHEC), guar or oil-based diesel oil, and kerosene gel with aluminum phosphate esters (e.g., Halliburton Services' "MY-T OIL II" gel, Dowell/Schlumberger's "YF-GO" gel, B. J. Titan's "ALLO-FRAC" gel, and The Western Company of North America's "MAXI-O" gel).

The proppant concentration in the viscous gel should be from about one to about 18 pounds per gallon. In those situations where high temperatures are encountered a fused refractory proppant can be used and should be in the amount of about 10 to about 18 pounds per gallon. These proppants include silicon carbide, silicon nitride or a garnet proppant and mixtures thereof. These proppants are particularly preferred when high temperature effects of steam are encountered.

Figure 1:
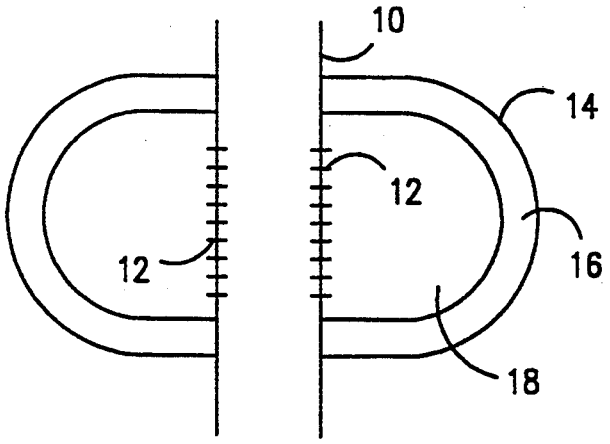
FIG. 1 PRIOR ART
FIG. 1 is a schematic representation which depicts a neat fracturing fluid which has created a fracture in the formation which is then followed by a proppant laden fracturing fluid.

In carrying out a hydraulic fracturing treatment as is shown in FIG. 1, it is a desired practice to first inject a fluid pad or neat "frac" fluid lacking a proppant therein into the formation to initiate the fracture. Thereafter, a very low concentration of propping agent or fused refractory material along with the "frac" fluid is injected into the fracture to ensure that the fracture has taken the propping agent or fused refractory material. As the fracture propagates into the formation and a greater fracture area is created, increased amounts of proppant 18 are added to the fracturing or "frac" fluid. This is illustrated in FIG. 1. Here as is shown the neat fluid enters wellbore 10 and exits the wellbore by perforations 12. The neat fluid 16 enters the formation and creates a vertical fracture 14.

Figure 2:
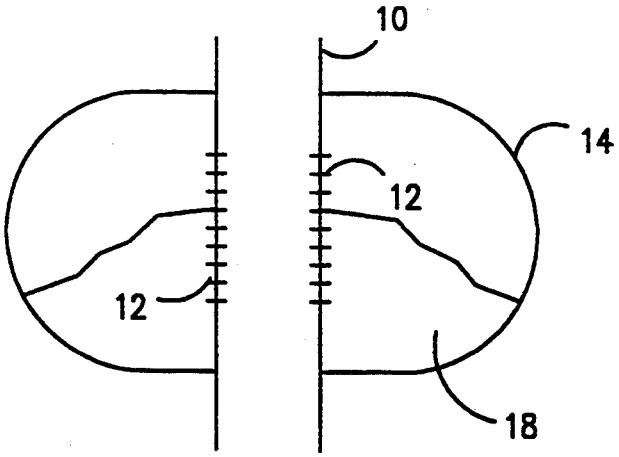
FIG. 2 PRIOR ART
FIG. 2 is a schematic representation of the created fracture which shows settlement of proppant and convection effects upon the proppant.

During the conventional fracturing operation, as is shown in FIG. 2, proppant 18 from the injected fracturing fluid has fallen to the bottom of fracture 14 due to gravitational or "convectional" effects on the proppant. This is an undesired situation since nearly all of the proppant has settled to the bottom and the main part of fracture 14 still lacks sufficient proppant therein to hold fracture 14 open.

Figure 3:
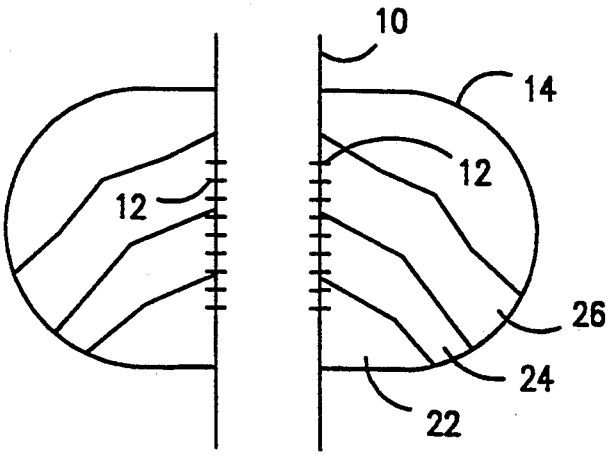
FIG. 3 represents schematically the placement of alternating slugs of a proppant laden "frac" fluid followed by a thin spacer fluid which avoids the proppant convection effect.

In the practice of this invention, after creating the initial fracture, as is shown in FIG. 3, a gel "frac" fluid with proppant therein is injected into wellbore 10 whereupon it enters the formation via perforations 12 which causes fracture 14 to form vertically. While the fracturing pressure remains on the wellbore and fracture 14, a thin spacer fluid is next injected into the fracture via perforations 12 in wellbore 10. The thin spacer fluid which is utilized comprises the fracturing fluid which has been diluted in a manner so as to allow the proppant from a subsequently injected fracturing fluid containing proppant to fall therethrough. This initial increment of proppant laden "frac" fluid 22 falls to the bottom of fracture 14. Thereafter, a second proppant laden fracturing fluid 24 is directed into the wellbore and out through perforations 12.

Upon entering fracture 14 proppant from the second stage "frac" fluid 24 falls through the thin spacer fluid thereby obtaining a more even distribution of the proppant in the fracture. Afterwards, a third increment of proppant or stage of proppant laden "frac" fluid 26 is directed into the wellbore and out through perforations 12 where it causes the proppant to settle out above the second increment or stage of "frac" fluid 24 which was previously placed into the fracture. Thereafter, if required another slug of thin spacer fluid can be directed into fracture 14 via perforations 12. Should it be necessary, an additional increment or stage of proppant laden fracturing fluid can be directed into the fracture so as to fall through the thin spacer fluid and obtain a more even distribution of proppant over the main area of the fracture.

By repeating the steps as necessary, a more even distribution of proppant within the main area of the fracture can be obtained thereby avoiding proppant convection in the fracture and obtaining a substantially improved propping of the fracture. As each increment of proppant laden "frac" fluid is directed into the fracture, the concentration of proppant contained in each subsequent increment or stage is less than the prior increment or stage of "frac" fluid. At the conclusion of the fracturing operation, wellbore 10 is shut in to allow the fracture to close. The thin fluid spacer is effective because it dilutes a portion of the proppant slurry in the fracture and causes the proppant to drop into the created fracture. Since the fluid spacer is thin, it has high fluid leak off properties compared to the gel "frac" fluid which carries the proppant. Thus, it allows some intermittent closure of the fracture to an extent sufficient to trap slurry proppant before it falls.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed:

1. A method of enhanced hydraulic fracturing where a sealing liquid is not used subsequent to formation or reservoir breakdown comprising:

a) injecting a fracturing fluid into a formation at a pressure and rate sufficient to fracture said formation which fracturing fluid lacks a proppant therein;

b) hydraulically fracturing a formation or reservoir with a proppant laden fracturing fluid at a pressure and rate sufficient to create a fracture that is held open with said proppant which fracturing fluid is not subsequently cross-linked;

c) injecting next a thin spacer fluid into the created fracture while the fracturing pressure is maintained which spacer fluid is diluted so as to allow proppant from a subsequently injected fracturing fluid to fall through said spacer fluid while the fracturing pressure is maintained; and d) injecting thereafter a proppant laden fracturing fluid containing a proppant at a rate and pressure sufficient to hold the created fracture open which allows proppant to be more evenly distributed throughout the created fracture as proppant falls through the spacer fluid thereby enhancing proppant convection in the created fracture and obtaining substantially improved propping of the fracture.

2. The method as recited in claim 1 where in step a) the fracturing fluid comprises a gelled or ungelled fluid.

3. The method as recited in claim 1 where steps c) and d) are repeated until a desired amount of proppant has been placed in the fracture.

4. The method as recited in claim 1 where the thin spacer fluid comprises a diluted fracturing fluid.

5. The method as recited in claim 1 where the spacer fluid has high fluid leak off properties compared to the fracturing fluid with proppant therein which allows intermittent closure of said fracture to an extent sufficient to trap the proppant before it falls.

6. The method as recited in claim 1 where in steps b) and d) the proppant is added to the fracturing fluid in concentrations from about 1.0 pound to about 18 pounds per gallon.

7. A method of enhanced hydraulic fracturing where a sealing liquid is not used subsequent to reservoir or formation breakdown comprising:

a) injecting a fracturing fluid without proppant therein into a formation or reservoir at a pressure and rate sufficient to fracture said formation;

b) injecting next into said formation or reservoir a proppant laden fracturing fluid, that is not subsequently cross-linked, at a pressure and rate sufficient to hold open said fracture with said proppant;

c) injecting after step b) a thin spacer fluid into the created fracture while the fracturing pressure is maintained which spacer fluid is diluted so as to allow proppant from a subsequently injected fracturing fluid to fall through said spacer fluid;

d) injecting thereafter a proppant laden fracturing fluid containing a proppant at a rate and pressure sufficient to hold the created fracture open which allows proppant to be more evenly distributed throughout the created fracture as proppant falls through the spacer fluid thereby avoiding proppant convection in the created fracture and obtaining substantially improved propping of the fracture; and e) repeating steps c) and d) until a desired amount of proppant has been placed into the fracture.

8. The method as recited in claim 7 where the fracturing fluid comprises a gelled or ungelled fluid.

9. The method as recited in claim 7 where the thin spacer fluid comprises a diluted fracturing fluid.

10. The method as recited in claim 7 where the spacer fluid has high fluid leak off properties compared to the fracturing fluid with proppant therein which allow intermittent closure of said fracture to an extent sufficient to trap the proppant before it falls.

11. The method as recited in claim 7 where in steps b) and d) the proppant is added to the fracturing fluid in concentrations of from about 1.0 pound to about 18 pounds per gallon.

12. The method as recited in claim 7 where steps c) and d) are repeated with increasing amounts of proppant being added into each subsequent injection of fracturing fluid in step d) until a desired amount of proppant has been placed in the fracture.

* * * * *